US005447014A

United States Patent [19]

Adams et al.

[11] Patent Number: 5,447,014

[45] Date of Patent: Sep. 5, 1995

[54] CIGARETTE PACKING MACHINE EXIT APPARATUS

[75] Inventors: John M. Adams, Mechanicsville, Va.; Jeffrey M. S. Haskin, LaGrange, Ga.

[73] Assignee: Philip Morris Incorporated, New York, N.Y.

[21] Appl. No.: 81,974

[22] Filed: Jun. 23, 1993

Related U.S. Application Data

[63] Continuation-in-part of Ser. No. 3,846, Jan. 11, 1993, Pat. No. 5,249,416, which is a continuation of Ser. No. 700,759, May 15, 1991, abandoned.

[51] Int. Cl.[6] ..... B65B 19/02; B65B 51/10; B65B 51/32

[52] U.S. Cl. ..... 53/463; 53/148; 53/371.3; 53/374.2; 53/375.9

[58] Field of Search ..... 53/477, 463, 376.7, 53/376.6, 377.8, 377.7, 375.9, 376.2, 374.2, 387.3, 387.4, 234, 148, 444, 371.3, 370.8

[56] References Cited

U.S. PATENT DOCUMENTS

| | | | |
|---|---|---|---|
| 2,480,501 | 8/1949 | Moore | 53/463 |
| 2,638,724 | 5/1953 | Harvey | 53/463 |
| 2,697,474 | 12/1954 | McGinley | 53/371.3 |
| 3,010,267 | 11/1961 | Richardson et al. | 53/375.9 |
| 3,599,394 | 8/1971 | Vilen | 53/371.3 |
| 3,899,863 | 8/1975 | Seragnoli et al. | 53/53 |
| 4,362,593 | 12/1982 | Grevich | 53/374.2 X |
| 5,249,416 | 10/1993 | Adams et al. | 53/463 |

*Primary Examiner*—James F. Coan

*Attorney, Agent, or Firm*—Charles E. B. Glenn; James E. Schardt; Kevin B. Osborne

[57] ABSTRACT

A cigarette packing machine exit apparatus having a contoured heating surface and a pivoted heater retraction feature. The contoured surface preferably is in the form of diagonally oriented elongated narrow ridges that act as contact surfaces to concentrate heat on the seal of the cigarette packs being conveyed along the surface. The pivoted retraction feature serves to raise and then lower the heater when the packing machine is shut off so that the packs then on the heater surface are raised and are held spatially separated from the heater.

24 Claims, 9 Drawing Sheets

FIG. 5
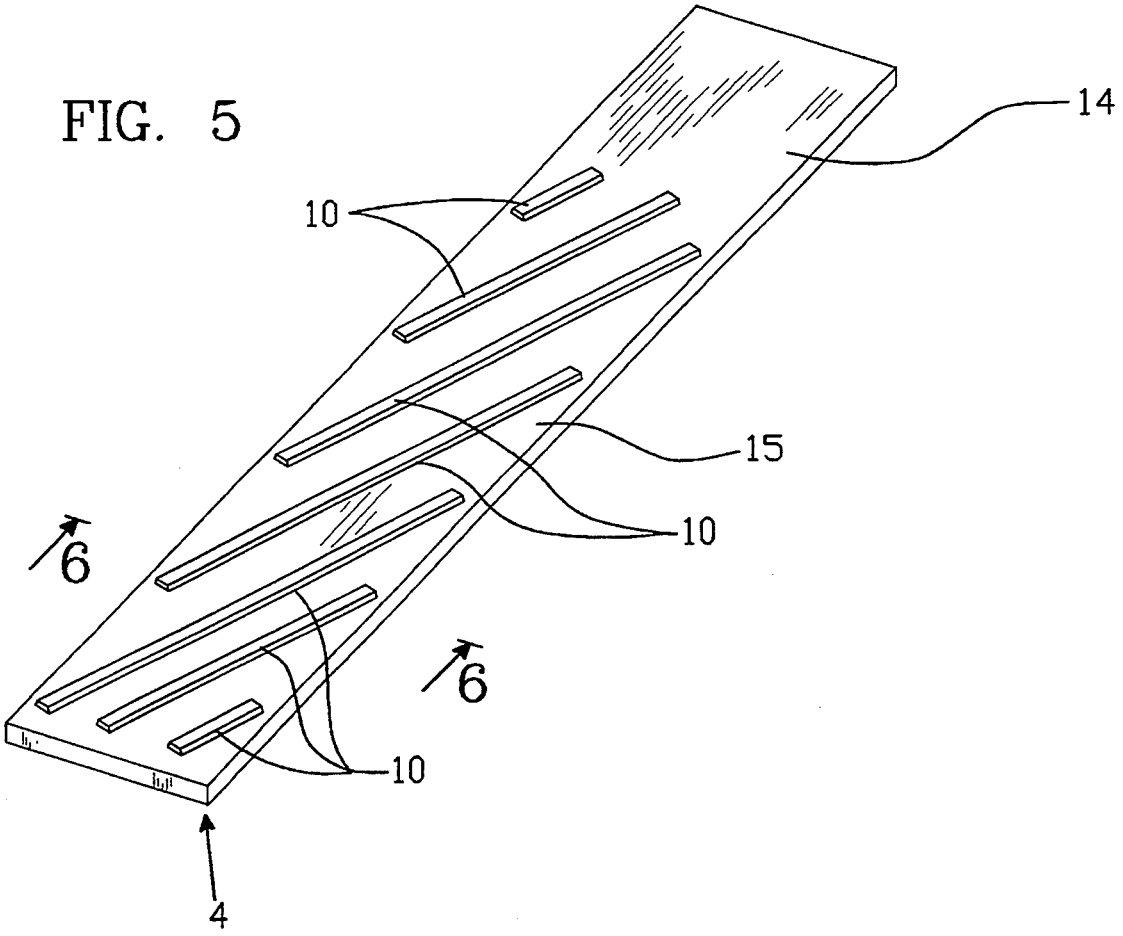
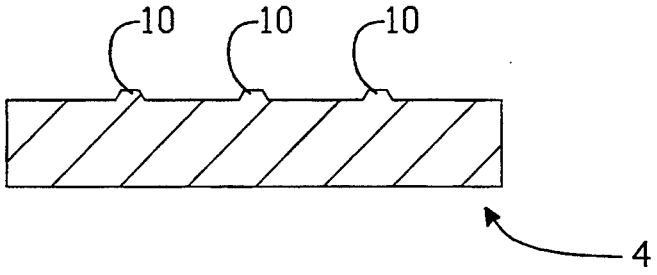
FIG. 6

CIGARETTE PACKING MACHINE EXIT APPARATUS

CROSS-REFERENCE TO RELATED APPLICATION

This application is a continuation-in-part of, commonly-assigned U.S. patent application Ser. No. 08/003,846, filed Jan. 11, 1993, which is a continuation of U.S. patent application Ser. No. 07/700,759, filed May 15, 1991, now abandoned, which are both hereby incorporated by reference in their entirety. Ser. No 08/033,846 issued as U.S. Pat. No. 5,249,416 on Oct. 5, 1993.

BACKGROUND OF THE INVENTION

The present invention relates to an apparatus and method for packing cigarettes into cigarette packs and sealing the packs with pre-applied adhesives. More particularly, the present invention relates to sealing cigarette packages in which the packaging stock, such as the pack labels, is coated with a dry adhesive before it is supplied to the packaging machine; the apparatus provides improved means for activating and for setting the adhesive.

Cigarette packing machines are widely used in high speed cigarette manufacturing operations. In typical commercial wet adhesive ("wet-glue") packing machines, cigarettes pass through successive processing steps in order to be formed into packs. A typical soft cigarette pack manufactured by such machines comprises an internal liner, an external label, which typically is made of coated paper, and a closure stamp. Water based or other solvent based or wax based adhesives are commonly used as adhesives to seal the packaging. Typically such wet glue is applied to the label at an edge corresponding to the sideseam of a cigarette pack and at another edge corresponding to the folded over bottom of the cigarette pack; the label is then wrapped around a bundle of cigarettes, usually 20 in number, that has already been wrapped in a foil liner. The wet glue is set by holding the label in place until the glue has dried. Heat may be applied in order to accelerate drying.

Wet-glue cigarette packers are widely known in the art of cigarette packaging. Exemplary versions of wet-glue packers are described in U.S. Pat. Nos. 3,628,309 and 3,948,115, both of which are assigned to G. D. Societa per Azioni, Via Pomponia 10, 40100 Bologna, Italy, which sells commercial wet-glue packers under various model designations, including GDX-1.

In addition to apparatus for the application of wet glue to the labels, the known wet-glue-type packers typically incorporate four processing turrets, each performing predetermined processing functions while passing cigarette bundles from turret to turret. The fourth turret functions first to finish the label folds on the bottom of the pack and then to set the glue on that bottom panel by operating in conjunction with a heating assembly having a flat raised portion designed to contact the pack bottoms and thereby set the glue by application of heat and pressure.

The known wet-glue-type packers also typically incorporate exit ramps, onto which the wrapped cigarette bundles enter after exiting the fourth processing turret. The exit ramp comprises a flat heater plate, a top pressure plate and conveying means, typically two conveyor belts. The heater plate and the top pressure plate operate in conjunction to set the sideseam glue as the cigarette packs are transported along the exit ramp by the conveyor belts.

Wet-glue packing machines possess a number of known disadvantages. Among these disadvantages are: slippage, which occurs when opposing portions of the packaging stock move with respect to each other before the wet glue is set such that the desired predetermined alignment is not achieved clogging, which occurs when the apparatus used to apply the wet glue becomes blocked or when wet glue causes the downstream processing apparatus to become clogged; and smearing, which occurs, for example, when glue seeps out from glued seams, when it bleeds through the stock, when it smears from its position or when it slings. Other disadvantages of wet-glue packaging machines are due to the following: product loss from machine stoppages for de-clogging or other maintenance, lack of flexibility regarding the placement of adhesive, difficulty in controlling the amount of glue that is applied, high viscosity of the glue itself, glue build-up along guides and frequent maintenance required by the glue application apparatus.

The invention disclosed in prior copending application Ser. No. 08/003,846 alleviates to a great extent the disadvantages of the prior art by disclosing cigarette packaging machines and methods that utilize packaging stock comprising a pre-applied adhesive to form cigarette packages that are sealed by activating the pre-applied adhesive. In one embodiment of that invention, packs are formed by wrapping labels having a pre-applied dry adhesive around a liner-wrapped cigarette bundle and then sealing the pack by activating the pre-applied adhesive, such as through the application of heat, and setting the adhesive, such as by cooling below the high activation temperature.

In an embodiment of the cigarette packer of the invention of copending commonly-assigned U.S. application Ser. No. 08/003,846, the exit ramp apparatus is split into heating and cooling zones to thereby effect the activation and setting of the sideseam seal. In that embodiment, after the packing machine is turned off, the machine continues to process packs that are then on the exit ramp apparatus so that all of the packs are processed and transferred from the machine and are not degraded by remaining on the heater. The many advantages of the invention of copending application Ser. No. 08/003,846 are discussed in that application.

One disadvantage of the known exit ramp apparatus is that the entire exit ramp is heated, typically to high temperatures, in order to activate pre-applied adhesive or to dry wet glue on the cigarette pack sideseam. It is desirable to be able to activate and set the sideseam seal at a temperature lower than previously required.

Another disadvantage is that the surface of the exit ramp is flat and is not uniformly heated, thereby creating non-uniform seals. Because the bottom plate is typically heated by heating elements underneath, the flat surface of the bottom plate may not be uniformly heated across its surface or from one end to the other. As a result, the cigarette pack label sideseams may not be uniformly sealed. It is desirable to be able to provide a more complete and uniform sideseam seal.

A further disadvantage of wet-glue packers is heat degradation or burning that occurs when packs remain on the heated exit ramp after the packer is shut off.

SUMMARY OF THE INVENTION

It is therefore an object of the present invention to make use of a prior apparatus and method for packing cigarettes in packs using pre-applied adhesive and apparatus for activating and setting the pre-applied adhesive.

It is another object of the present invention to activate and set the heat-activated sideseam seal of the cigarette pack at a temperature lower than previously required.

It is still another object of the present invention to effect a better and more uniform heat-activated sideseam seal without significant modifications of the wet-glue cigarette packer exit ramp effecting the seal.

It is yet another object of the present invention to provide another solution to the problem of overheating of the cigarette packs remaining on the heated exit ramp after shut-down of the packer.

These and other objects of the invention are accomplished in accordance with the principles of the invention by providing a cigarette packing machine having an exit ramp with a bottom surface comprising a heater plate and, in one embodiment, a cooling plate. The upper surface of the heater plate (the contact surface) is contoured to effect a more complete seal on the cigarette pack sideseams. A pivoted heater retraction mechanism reduces heat degradation of packs left on the heater plate for extended periods.

The contoured surface of the heater plate preferably has raised ridges that are oriented diagonally on the contact surface. The raised ridges function as pressure points to concentrate the heat as the cigarette pack sideseams contact the heater plate's contact surface, thereby reducing the temperature needed to activate the binder on the seams. The diagonal orientation of the preferred ridges effectively serves to move the pressure points across the sides of the cigarette packs and along each sideseam from one end to the other as the packs progress along the heater plate.

In a preferred embodiment, the heater plate is pivotally mounted such that it can be elevated at one longitudinal end while being pivoted about an axis at the other end, enabling one end of the heater plate to be raised and retracted. In another embodiment, the heater plate is mounted such that it can be elevated at both longitudinal ends, enabling the entire heater plate to be raised and retracted. This raising and retracting feature is utilized when the cigarette packer is stopped, in order to create a spatial separation of the packs from the heater plate. Raising the heater plate serves to push the cigarette packs that are on the exit ramp upward. Then, when the plate is retracted back to its operating position, the cigarette packs are removed from contact with the heater plate by being held in the raised position by exit ramp conveyor belts.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which:

FIG. 3(*i*) is plane view of an alternate embodiment of the heater plate of the present invention;

FIG. 3(*ii*) is a partial plan view of another alternate embodiment of the heater plate of the present invention;

FIG. 5 is an exit end, side perspective view of an alternate embodiment of the heater plate of the present invention;

FIG. 6 is a vertical cross-sectional view of an alternate embodiment of the heater plate of the present invention, taken along line 6—6 of FIG. 5;

DETAILED DESCRIPTION OF THE INVENTION

A sealed cigarette pack is formed by using a cigarette packer and dry adhesives, such as described in co-pending commonly assigned patent application Ser. No. 08/003,846. The cigarette packer wraps a bundle of cigarettes first with a foil liner and then with a label having a pre-applied dry adhesive. The cigarette packer then forms seals, first at the pack bottom using a heat-applying processing turret and then at the pack sides using a heat-applying portion of an exit ramp.

In one aspect of the present invention, the heated portion of the exit ramp bottom plate (the heater plate) comprises ridges that are formed on its surface at a diagonal to the longitudinal direction of the plate. These raised ridges function as pressure points to concentrate the heat from the heater plate on reduced areas of the cigarette pack sideseam that contact the ridges.

In another aspect of the present invention, when the cigarette packing machine is shut off, the heater plate is raised and then returned to its original position. In one embodiment, the heater plate is raised at one end while being pivoted at the other end, and in another embodiment the heater plate is raised at both ends. The raising of the heater plate pushes the cigarette packs being conveyed along the exit apparatus upward so that the subsequent retraction of the heater plate leaves the cigarette packs held by the tension of the conveyor belts in a raised position. As a result, a gap is created such that the packs are separated from and are not heated by the heater plate when the packing machine is not in use.

Figure 1:
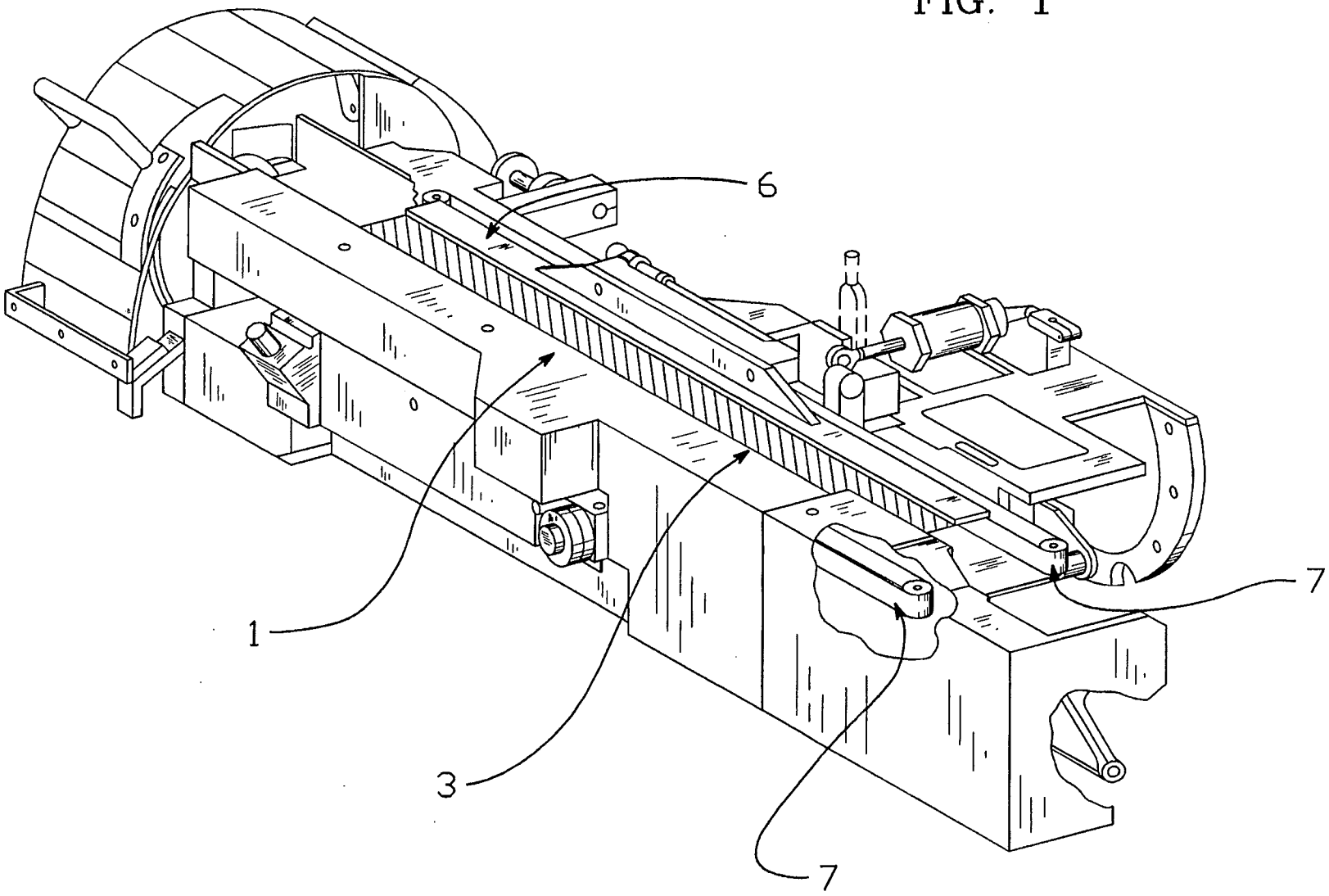
FIG. 1 is a perspective view of the cigarette packing machine exit ramp of the present invention.

FIG. 1 shows a known wet-glue cigarette packer exit ramp apparatus 1 that has been modified in accordance with the present invention. Cigarette packs enter onto the exit ramp after having been wrapped in labels by the processing turrets. These labels, as disclosed in prior application Ser. No. 08/003,846, preferably have a heat-activated dry adhesive pre-applied at edges corresponding to the sideseam of the cigarette pack and the folded over bottom of the cigarette pack, such that the labels are sealed around each pack by application of heat.

Figure 2:
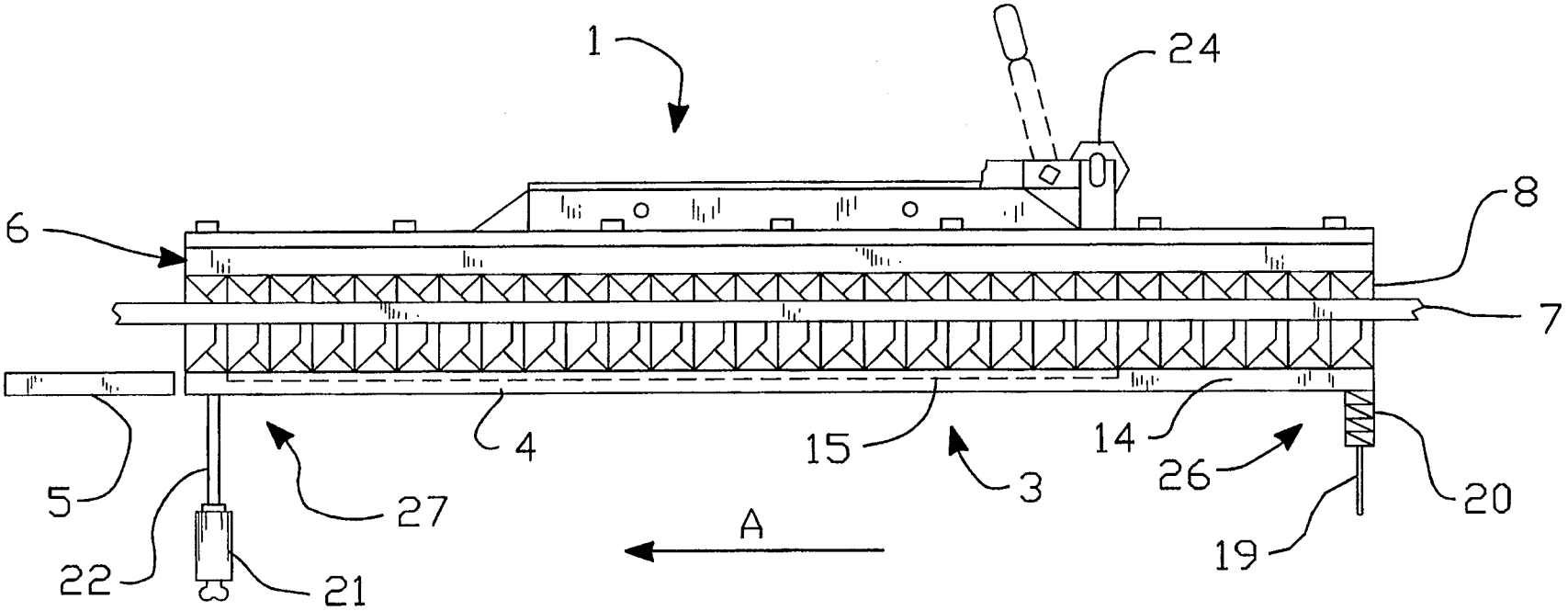
FIG. 2 is a side elevational view of the exit ramp of the present invention.

As illustrated in FIG. 2, the exit ramp apparatus 1 of the present invention comprises a bottom plate apparatus 3 comprising a heater plate 4 and a cooling plate 5, a top pressure plate 6 and conveying means 7. The conveying means can be any means for transporting the cigarette packs along the bottom plate 3, such as an inclined vibrating bottom plate or a pocket chain, but preferably comprises side conveyor belts 7. Each cigarette pack enters onto the exit ramp 1, sideways, resting on the unsealed label sideseam. Each pack is conveyed longitudinally along the bottom plate 3 from entrance end 26 to exit end 27 by conveyor belts 7 that impinge upon each pack at its top and bottom. Any number of conveyor belts 7 may be used in order to effect the longitudinal entrance 26 to exit 27 motion.

As the packs 8 are transported along the exit ramp by the conveyor belts 7 in the direction indicated by reference arrow A in FIG. 2, the top pressure plate 6 applies intermittent downward pressure by patting down onto the upward-facing sides of the cigarette packs so that the opposite sides of the packs are contacted with the bottom plate 3. In this way, the downward-facing side of each cigarette pack contacts the bottom plate 3, both at the heater plate portion 4 and at the cooling plate portion 5. The sideseam adhesive is thus both activated and set uniformly.

The heater plate 4 of the bottom plate apparatus 3 comprises raised contact surfaces 10 that are formed on its otherwise flat surface. This novel heater plate 4 is shown in more detail in FIGS. 3–6. As the packs are moved along the heater plate 4, the packs contact the plate only at the raised positions of the bottom plate. These raised contact surfaces 10 serve as pressure points to concentrate the heat from the heater 4 onto the label sideseam.

Because the heat from the heater plate 4 is transferred to the cigarette packs over a smaller, more concentrated, area by using the raised contact surfaces 10, the sideseam seal can be activated at lower temperatures than previously required with a completely flat heater plate surface. One result of concentrating the heat on these contact surfaces is that less heat from the heater plate is required to activate the seal on the cigarette packs.

Figure 3:
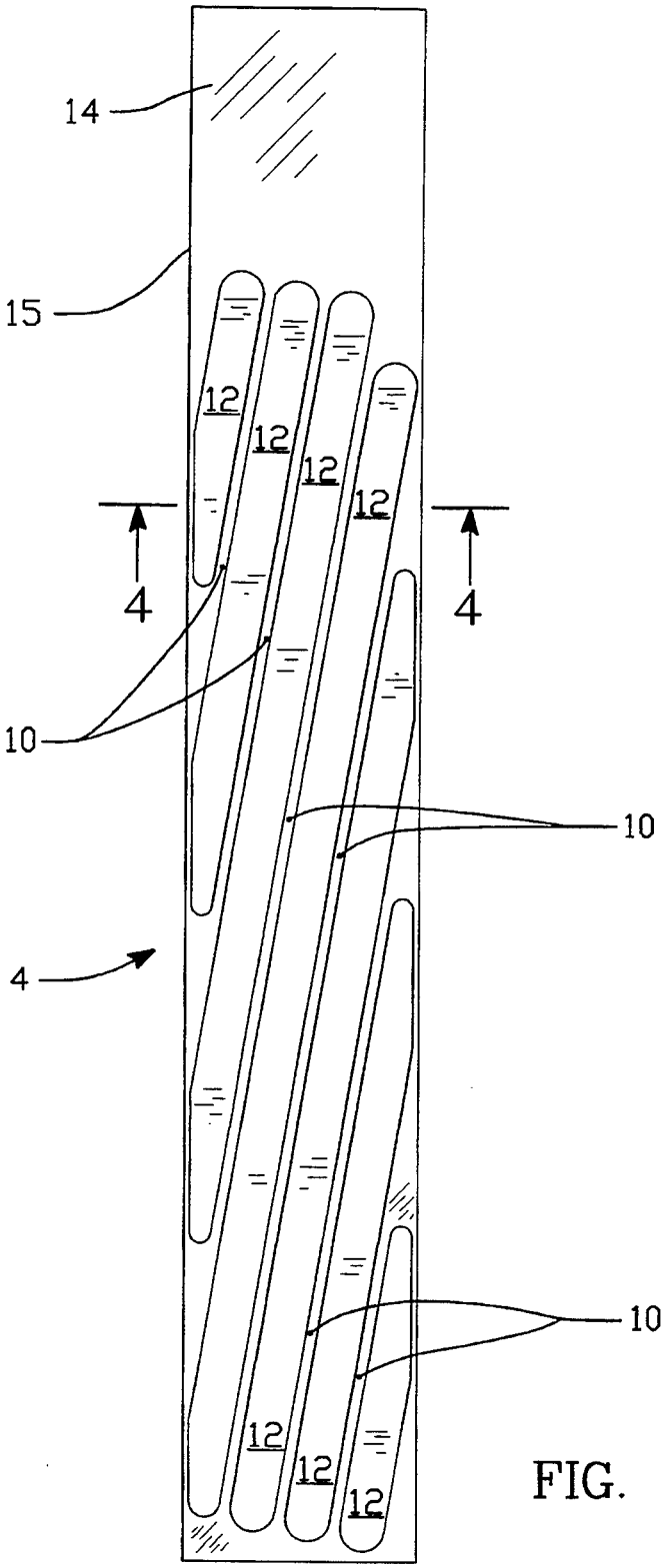
FIG. 3 is a plan view of the preferred embodiment of the heater plate of the present invention.
Figure 4:
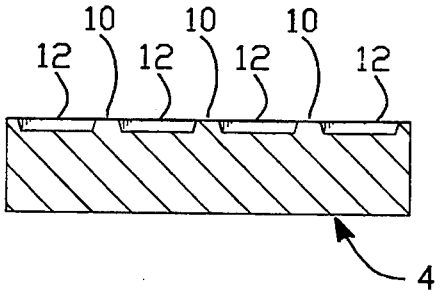
FIG. 4 is a vertical cross-sectional view of the preferred embodiment of heater plate of the present invention, taken along line 4—4 of FIG. 3.
Figure 3I:
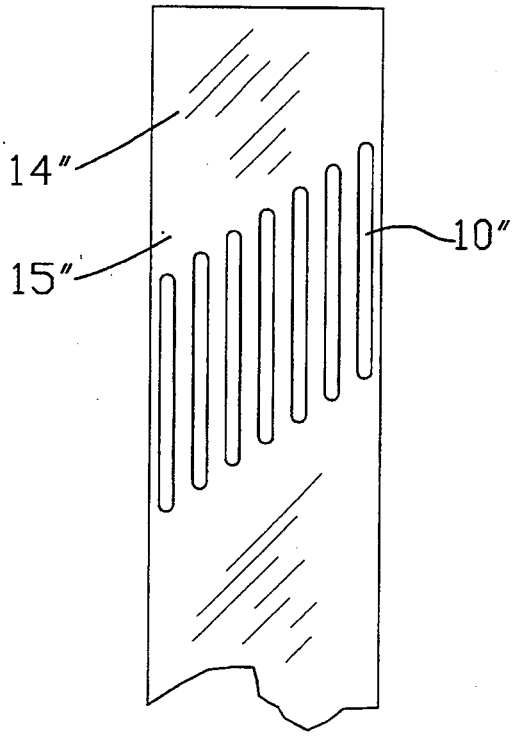
Figure 3I:
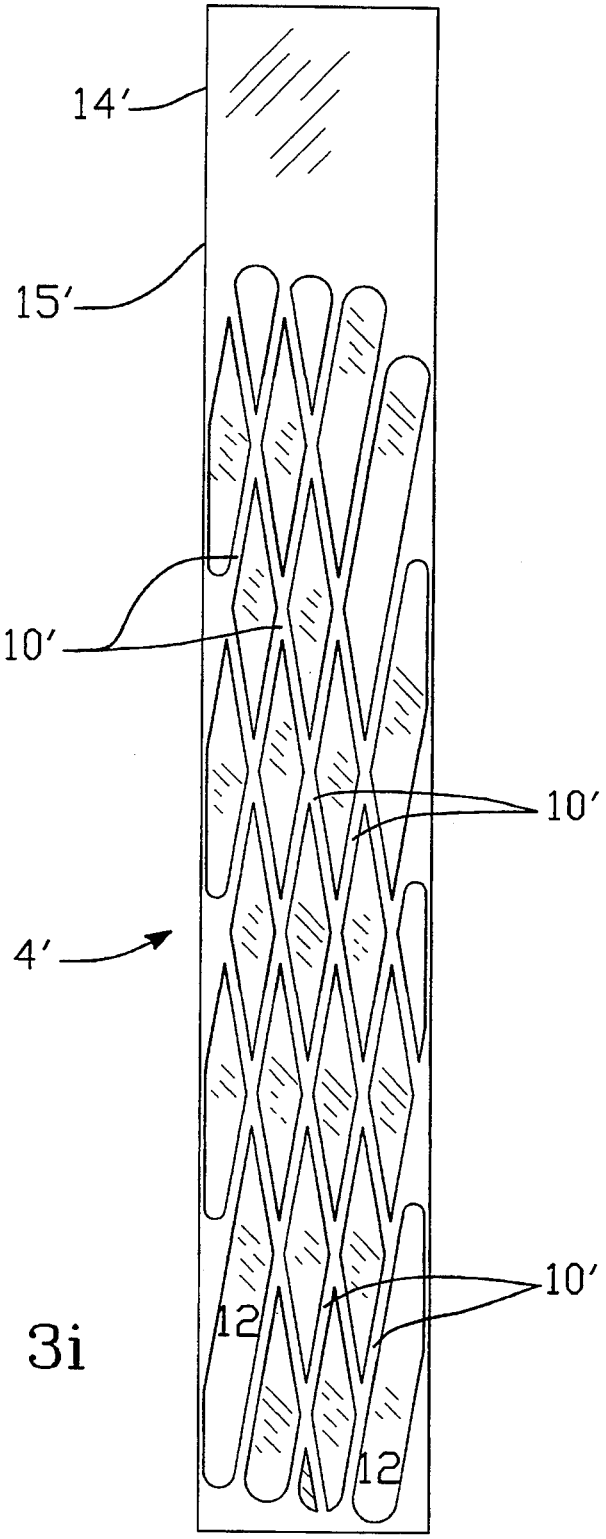

In the preferred embodiment of this invention, shown in FIG. 3, elongated ridges 10 in the heater plate 4 are formed parallel to each other and at a diagonal to the longitudinal direction of the plate. These diagonal elongated ridges 10 effectively serve to move the raised pressure points across the sides of the cigarette packs as the packs are moved in the longitudinal direction along the heater plate 4. In this way, concentrated heat is applied along the seal, progressing from one end of the seal to the other.

In an alternative embodiment of this invention and with reference to FIG 3(*i*), elongated ridges may be formed on the bottom plate such that the ridged portions of the bottom plate form intersecting crossing patterns, such as an "X". In another alternative embodiment and with reference to FIG. 3(*ii*), a series of shortened ridges is formed so that the ridges are parallel to each other in the longitudinal direction of the heater plate but are offset slightly from one another such that the row of short ridges is generally at a diagonal to the longitudinal direction of the heater plate. Other alternative ridging patterns also can be formed such that the raised contact portions are in a generally angular pattern such that the raised pressure points move across the sides of the packs as the packs progress along the bottom plate.

The raised contact surfaces may be manufactured using any known process. Die-casting can be used to form elongated narrow ridges 10 as part of the surface of the heater plate 4 at the time of its manufacture. Rather than casting a flat bottom plate surface, a ridged bottom plate surface is cast. Such ridges are shown in FIGS. 5 and 6.

The preferred method of creating the narrow raised contact surfaces 10 is by beveling elongated grooves 12 into the flat surface of the heater plate 4. These grooves 12 are shown in cross-section in FIG. 4. After beveling, the remaining raised portions 10 function as the pressure points that concentrate the bottom plate heat onto the cigarette pack sideseam as the pack moves along the heater plate 4. This beveling method may be used to modify the existing bottom plates of known exit ramps.

Alternatively, the beveled heater plate 4 may be further modified by being inlayed with a heat insulating material between the ridges 10 (not shown). After beveling grooves 12 into the flat heater plate, a heat insulating material, such as a high temperature plastic, is poured into the grooves and allowed to dry. Or, preformed ceramic inserts may be placed between ridges 10. The heat insulating material helps to shield the cigarette packs 8 resting on the bottom heater plate ridges 10 from the convective heat of the bottom plate, thus preventing convective overheating of the cigarette packs.

In a preferred embodiment of this invention, the contact ridges 10 are formed by beveling grooves 12 approximately 30/1000" deep, approximately $\frac{5}{8}$" wide and approximately $\frac{1}{8}$" apart. In effect, this creates a profile with contact points each 30/1000" high and $\frac{1}{8}$" wide, and spaced $\frac{5}{8}$" apart. Alternatively, the raised contact ridges 10 may be formed by beveling grooves 12 with different, more suitable depth, width and spacing.

Also in the preferred embodiment, the contact surfaces 10 preferably do not extend along the entire length of the heater plate 4, but rather extend along the portion of the length closest to the exit end 27, preferably the last 80% of the length of the heater plate 4. The first portion 14 of the heater plate, closest to entrance end 26, is flat, without any grooves or raised portions, as shown in FIGS. 3 and 5. Thus, when the cigarette packs enter onto the exit ramp at the entrance end 26 and move along the exit ramp toward the exit end 27, the downward-facing sides of the cigarette packs, having the label seam to be sealed, contact the entire width of the heater plate 4 for the initial portion 14 of the plate's length. Then, for the final portion 15 of the plate's length, the cigarette packs contact the raised contact surfaces 10. The effect of this flat/ridged construction of the heater plate 4 is that a slight partial seal is formed in each cigarette pack sideseam by the initial flat portion of the heater plate 4. This partial seal helps to diminish the possibility of skewed or uneven seals in the progressive sealing process of the present invention.

Figure 7:
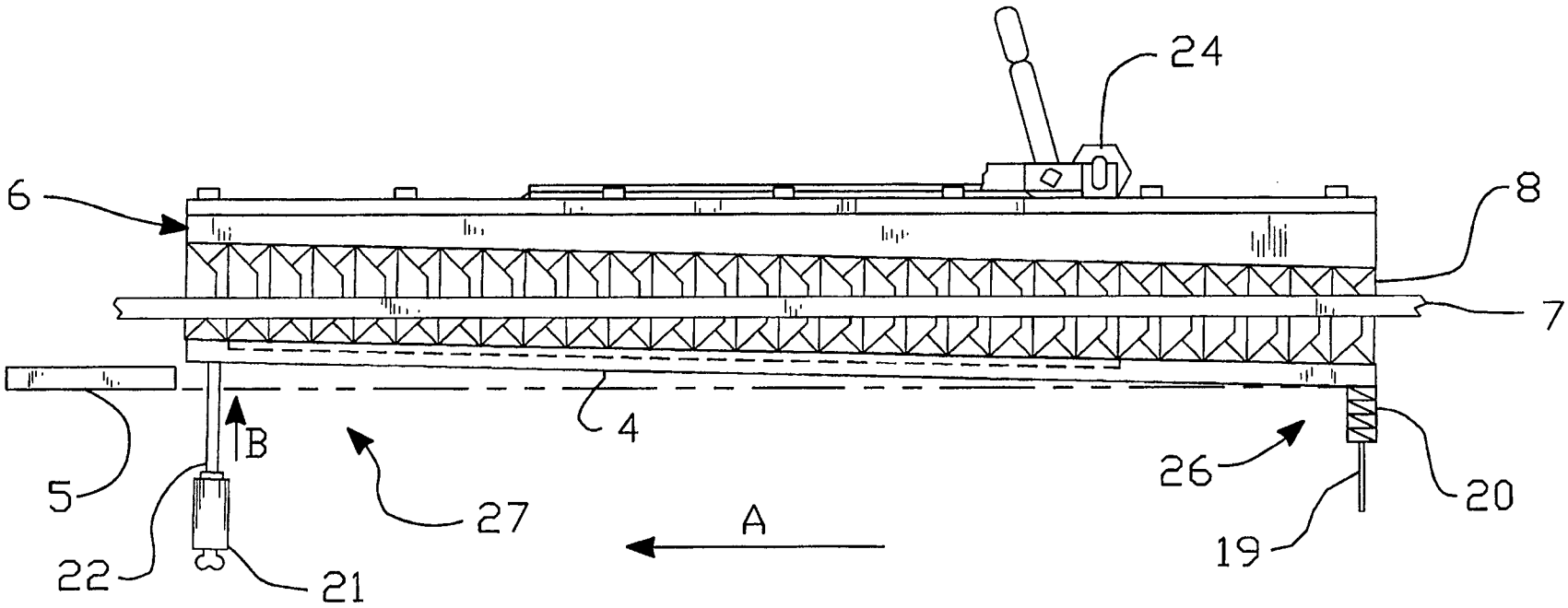
FIG. 7 is a side elevational view of the exit ramp with the heater plate of the present invention raised at one end and pivoted at the other.
Figure 8:
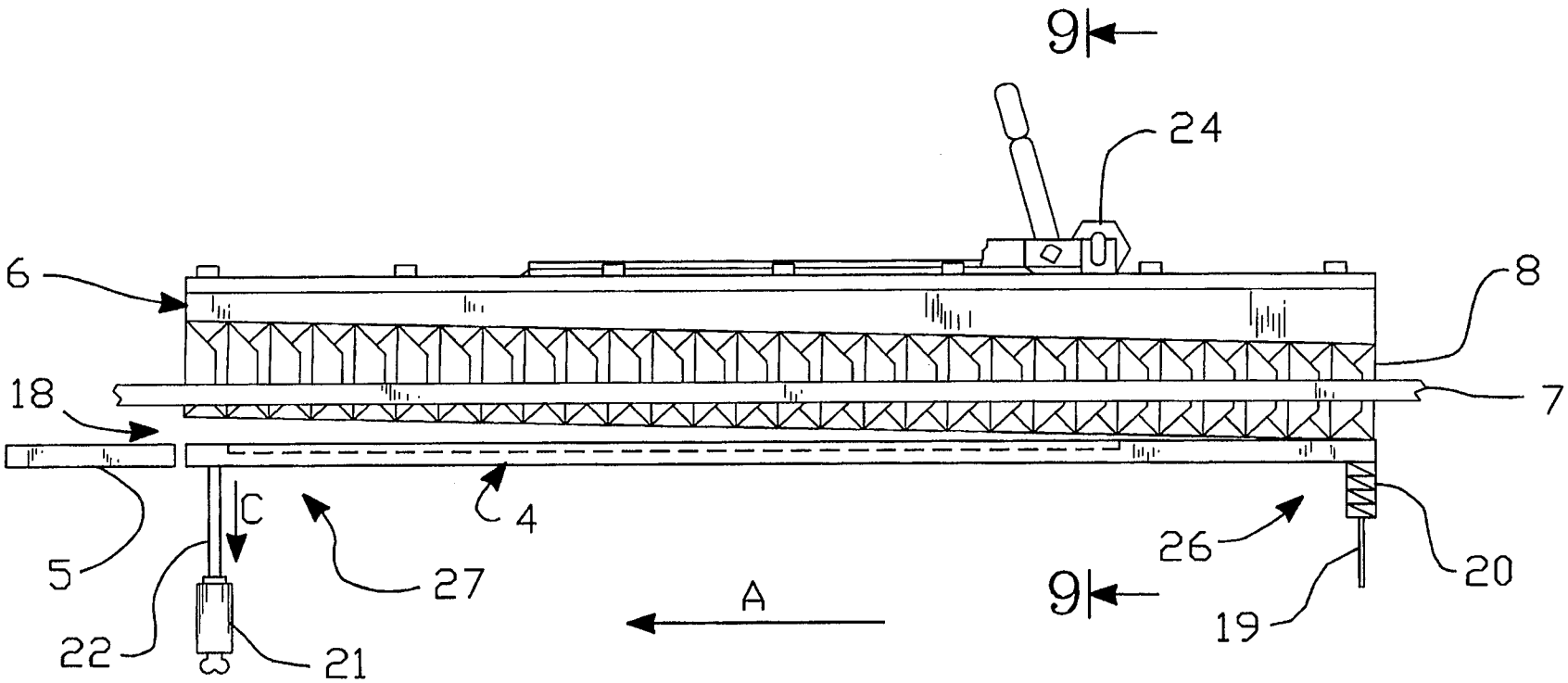
FIG. 8 is a side elevational view of the exit ramp after the heater plate has been raised and retracted.

After the cigarette packs are conveyed past the heated portion of the exit ramp, they are conveyed to the cooling portion of the exit ramp. The cooling portion may be a separate plate 5, as shown in FIGS. 7 and 8, or may be a continuous portion of the exit ramp bottom plate 3 downstream of the heater portion 4 of the exit ramp bottom plate. The cooling portion preferably is a combination having two sequential components.

The first part preferably is a cooled section at the exit end of the heated plate 4 and the second part preferably is a separate cooling plate 5 downstream of the heated plate 4. The separate cooling plate 5 may be a separate metal plate generally at ambient temperature, i.e. without forced cooling. To avoid heating due to proximity with heater plate 4, the cooling plate 5 preferably is cooled by external means, such as by passing cool air or liquid under it, or by some other cooling method. The cooling portion of the exit ramp may be flat or may be contoured in one of the ridging patterns discussed above.

In another aspect of the present invention, when the packing machine is shut off, the heater plate 4 is raised and then is returned to its original position. In a first preferred embodiment, the heater plate 4 is raised at one end while being pivoted at the other end. In a second embodiment, the heater plate 4 is raised at both ends. Raising and retraction of the heater plate in the preferred embodiment are illustrated in FIGS. 7 and 8 respectively. Raising the heater plate 4 pushes the cigarette packs 8 that are being conveyed along the exit apparatus upward so that the subsequent retraction of the heater plate 4 to its original position leaves the packs 8 held in a raised position by the tension of the conveyor belts 7. As a result, a gap 18 is created between the heater plate 4 and the cigarette packs 8 such that the packs 8 are spatially separated from and are generally not heated by the heater plate 4 when the packing machine is not in use. The spatial gap between the packs 8 and the heater plate 4 reduces the heat transferred to the packs 8, thus protecting the packs 8 from over-heating by the heater plate 4 and the resulting heat degradation.

In a preferred embodiment, cool air is blown through the gap 18 between the packs 8 and the heater plate 4 to further cool the packs 8. Whereas creating the gap 18 prevents conductive overheating of the packs contacting the heater plate, blowing cool air through the gap 18 prevents convective overheating of the packs 8 by cooling the heat emanating from the heater plate 4.

Figure 9:
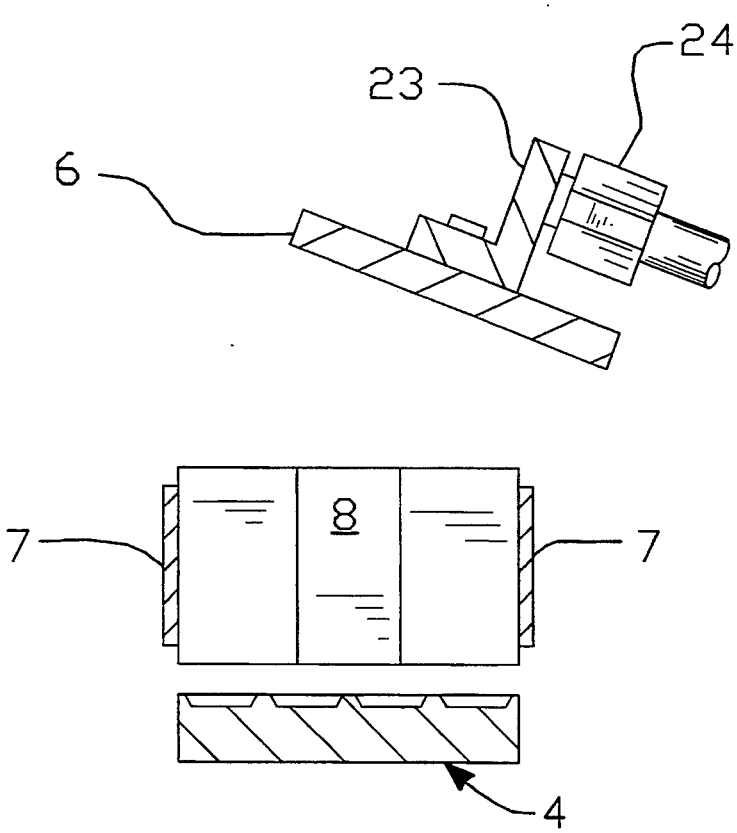
FIG. 9 is a vertical cross-sectional view of the exit ramp of the present invention taken along line 9—9 of FIG. 8.

The present invention also comprises a top pressure plate 6 that pats down on the upward-facing sides of the cigarette packs 8 so that the opposite sides of the cigarette packs contact the bottom plate 3. In a first embodiment of the top pressure plate, the top pressure plate provides fixed pressure intermittently upon the packs 8 so that they contact the bottom plate surface. In another embodiment, the top pressure plate 6 is spring-loaded so that the packs 8 are not crushed by the downward pressure of the top pressure plate 6. In still another embodiment, the top pressure plate is self-leveling so that pressure by the top plate 6 is applied to the cigarette packs 8 uniformly, causing the entire downward-facing side of each cigarette pack to contact the bottom plate 3. Self-leveling may be accomplished by a ball-and-socket mount, by a swivel mount or by some other suitable mounting means. In a further preferred embodiment, the spring-loaded top pressure plate 6 is also retractable, as shown in FIG. 9. It is preferable that top plate 6 be retracted prior to the raising of the bottom plate 4 so that cigarette packs 8 on the exit ramp are not crushed or deformed by opposing action of the two plates.

Any switching apparatus (not shown in the figures) may be used to turn the packing machine on or off—such as any of the known electrical and mechanical switches.

Figure 10:
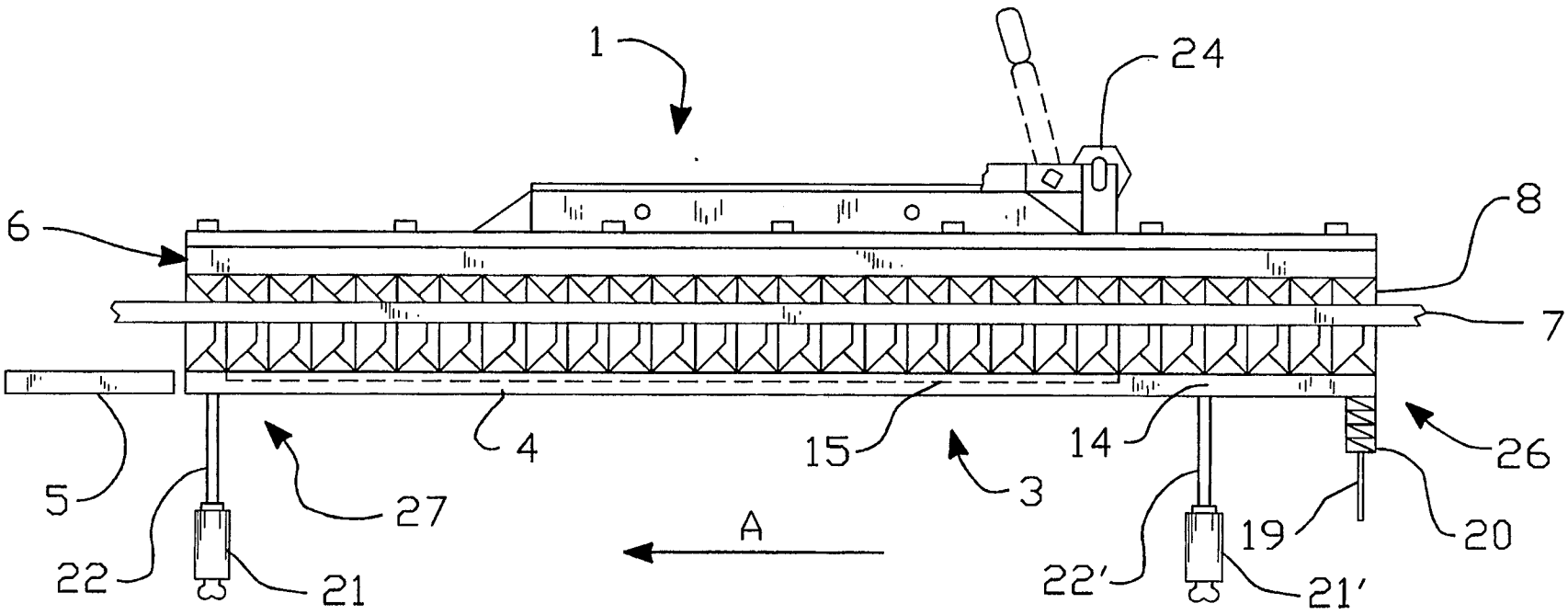
FIG. 10 is a side view of an alternate embodiment of the exit ramp in accordance with the present invention.

Any apparatus may be used for raising, retracting and pivoting the heater plate 4. In the first, preferred embodiment, at the pivot end, a long bolt 19 and a high tension spring 20 may be used to create a pivot axis. At the raised end, a double acting air cylinder 21 and a connecting rod 22 may be used to raise and retract that end of the heater plate 4. In this preferred embodiment, the exit ramp bottom plate 4 is raised at the exit end 27 of the exit ramp and is pivoted at the entrance end 26 of the exit ramp. Referring to FIG. 10, in a second embodiment, raising of the heater plate 4 is done at both the entrance end 26 and the exit end 27 of the exit ramp heater plate 4, preferably at the entrance end 26 by a second air cylinder 21' and connecting rod 2'.

Likewise, any apparatus may be used for raising and retracting the top pressure plate 6. In one embodiment, a shaft 23 connected to the top pressure plate 6 may be equipped with an air cylinder assembly 24 to retract the plate.

In the preferred embodiment of this invention, when the packing machine is switched off, the top pressure plate air cylinder 24 is activated to retract the top pressure plate 6, and then the bottom plate air cylinder 21 is activated to raise and lower the exit end 27 of the heater plate 4 in the directions indicated by reference arrows B and C in FIGS. 7 and 8, respectively. The entrance end 26 of the heater plate 4 remains pivotally mounted such that it pivots about spring 20 when the exit end 27 is raised and lowered. In the second embodiment of FIG. 10, after the top pressure plate 6 is retracted, a bottom plate air cylinder 21 and 21' on each end of the heater plate is activated to raise and lower the entire heater plate. Later, when the packing machine is restarted, the top pressure plate air cylinder 24 is reactivated so that the top pressure plate 6 moves back to its functional position and in the process pushes the suspended cigarette packs 8 back down into contact with the bottom plate 4.

The air cylinders 21, 24 are activated preferably by an electric solenoid valve linked through a timer relay to the GDX-1 packer stop circuit. Alternatively, any other suitable means for activating the air cylinders in this sequence may be used.

Further, in the preferred embodiment, the bottom plate air cylinder 21 raises the exit end 27 of the exit ramp's heater plate 4 by a preferred distance of at least one-half inch. In the second embodiment, both ends of the heater plate are raised by a preferred distance of at least one-half inch.

Thus, a cigarette packing machine exit apparatus is provided. One skilled in the art will appreciate that the present invention can be practiced by other than the described embodiments, which are presented for purposes of illustration and not of limitation, and the present invention is limited only by the claims that follow.

What is claimed is:

1. A cigarette packing machine exit apparatus for activating pre-applied adhesive on sideseams of cigarette packs, comprising:

conveying means for transporting the cigarette packs along an exit apparatus path means;

said exit apparatus path means comprising a heater plate, said heater plate comprising a top surface, an entrance end and an exit end opposite the entrance end, said top surface comprising a plurality of contact surfaces; and said conveying means being capable of transporting cigarette packs such that the sideseams of said cigarette packs contact at least a portion of said top surface of said heater plate;

wherein said contact surfaces comprise contact ridges, said ridges being parallel to each other and oriented diagonally with respect to the exit apparatus path.

2. The apparatus of claim 1 wherein said conveying means comprises a plurality of opposing conveyor belts arranged along transverse sides of said heater plate, said opposing conveyor belts arranged to receive top and bottom portions of cigarette packs being transported by said conveying means.

3. The apparatus of claim 1 wherein said conveying means comprises two opposing conveyor belts each running the entire longitudinal length of said exit apparatus path means.

4. The apparatus of claim 1 wherein said exit apparatus path means further comprises:

a cooling plate located downstream of said heater plate.

5. The apparatus of claim 1 wherein said contact ridges intersect with one another to create a plurality of crossing patterns.

6. The apparatus of claim 1 wherein said contact ridges extend along less than the entire length of said heater plate.

7. The apparatus of claim 1 further comprising heat insulating means, said heat insulating means being placed between said contact ridges to insulate said packs from said top surface.

8. The apparatus of claim 1, wherein said parallel ridges are off-set from one-another so as to define a row of ridges, said row oriented diagonally with respect to the exit apparatus path.

9. An apparatus for manufacturing cigarette packs, said cigarette packs comprising packaging stock that comprises a pre-applied adhesive, comprising:

feeding means for transporting the packaging stock along a feed path means;

assembling means for gathering a plurality of cigarettes that are to be included in each of said cigarette packs;

bundling means for forming a plurality of stock-wrapped bundles, said bundling means being located downstream of the feeding means and the assembling means, wherein the plurality of cigarettes provided by the assembling means are wrapped with packaging stock provided by the feeding means: wherein each of said stock-wrapped bundles comprises a sideseam: and wherein said apparatus for manufacturing cigarettes is a turret-type cigarette packing machine comprising:

a plurality of processing turrets including an activation turret; and exit apparatus means that is situated downstream of said activation turret, said exit apparatus means comprising:

an activation surface for activating the adhesive that is pre-applied on a portion of the packaging stock corresponding to the sideseam;

setting means for setting the pre-applied adhesive downstream of said activation surface; wherein said setting means comprises means for cooling the bottom of each of said stock-wrapped bundles by causing the sideseam to contact a cooling element;

wherein said activation surface comprises a heater plate means situated in proximity to said activation turret such that said heater plate means applies heat to the sideseam of each of said stock-wrapped bundles when each is on the exit apparatus means; wherein said heater plate means comprises a contoured contact surface.

10. A cigarette packing machine exit apparatus for activating pre-applied adhesive on sideseams of cigarette packs, comprising;

conveying means for transporting the cigarette packs along an exit apparatus path means;

said exit apparatus path means comprising a heater plate, said heater plate comprising a top surface, an entrance end and an exit end opposite the entrance end, said top surface comprising a plurality of contact surfaces; and said conveying means being capable of transporting cigarette packs such that the sideseams of said cigarette packs contact at least a portion of said top surface of said heater plate;

wherein said heater plate is mounted such that said heater plate is movable between an operating position and a raised potion and further comprising:

lifting means for moving said eater plate between said operating position and said raised position.

11. The apparatus of claim 10 wherein said lifting means is adjacent the exit end of said heater plate.

12. The apparatus of claim 11 wherein said lifting means is also adjacent the entrance end of said heater plate.

13. The apparatus of claim 10 further comprising:

switch means for switching said packing machine between operating and off conditions;

and wherein said lifting means causes said heater plate to be raised upwards when said switch means is activated to switch said packing machine to the off position.

14. The apparatus of claim 13 wherein said lifting means causes said heater plate to return to its operating position after said lifting means causes said heater plate to be raised upwards.

15. The apparatus of claim 13 wherein said heater plate further comprises opposite transverse sides, said opposite transverse sides being angularly separated from the entrance and exit ends; and said conveying means comprises a plurality of opposing conveyor belts, said conveyor belts being mounted on opposite transverse sides of said heater plate and being mounted such that they support said packs spatially separated from said heater plate after said lifting means causes said heater plate to return to its operating position.

16. The apparatus of claim 18 further comprising a top pressure plate, said top pressure plate being mounted to provide pressure to the cigarette packs opposing the top surface of said heater plate.

17. The apparatus of claim 16 wherein said top pressure plate is spring mounted.

18. The apparatus of claim 16 wherein said top pressure plate is swivel mounted such that said top pressure plate is self-leveling.

19. The apparatus of claim 16 wherein said top pressure plate is mounted such that said top pressure plate is movable between an operating position and a retracted position and further comprising:

retracting means for moving said top pressure plate between said operating position and said retracted position; and switch means for switching said packing machine between operating and off conditions;

and wherein said retracting means causes said top pressure plate to retract when said switch means is activated to switch said packing machine to the off position.

20. A cigarette packing machine exit apparatus for activating pre-applied adhesive on sideseams of cigarette packs, comprising:

conveying means for transporting the cigarette packs along an exit apparatus path means;

said exit apparatus path means comprising a heater plate, said heater plate comprising a top surface, an entrance end and an exit end opposite the entrance end, said top surface comprising a plurality of contact surfaces; and said conveying means being,capable of transporting cigarette packs such that the sideseams of said cigarette packs contact at least a portion of said too surface of said heater plate;

wherein said heater plate is pivotally mounted such that said heater plate is movable between an operating position and a pivoted position and further comprising:

pivot axis means to which said heater plate is pivotally mounted; and pivot motion means for moving said heater plate about said pivot axis means.

21. The apparatus of claim 20 wherein said pivot axis means is adjacent the entrance end of said heater plate.

22. The apparatus of claim 20 further comprising:

switch means for switching said packing machine between operating and off conditions;

and wherein said pivot motion means causes said heater plate to be pivoted upwards when said switch means is activated to switch said packing machine to the off condition.

23. The apparatus of claim 22 wherein said pivot motion means causes said heater plate to return to its operating position after said pivot motion means causes said heater plate to be pivoted upwards.

24. The apparatus of claim 23 wherein said heater plate further comprises opposite transverse sides, said opposite transverse sides being angularly separated from the entrance and exit ends; and said conveying means comprises a plurality of opposing conveyor belts, said conveyor belts being mounted on opposite transverse sides of said heater plate and being mounted such that they support said packs spatially separated from said heater plate after said pivot motion means causes said heater plate to return to its operating position.

* * * * *